United States Patent [19]

Taylor

[11] 4,219,164

[45] Aug. 26, 1980

[54] COMMINUTION OF PULVERULENT MATERIAL BY FLUID ENERGY

[75] Inventor: David W. Taylor, Edgemont, Pa.

[73] Assignee: Microfuels, Inc., Bala Cynwyd, Pa.

[21] Appl. No.: 21,061

[22] Filed: Mar. 16, 1979

[51] Int. Cl.[3] ..... B02C 19/06

[52] U.S. Cl. ..... 241/5; 241/39

[58] Field of Search ..... 241/30, 1, 26, 5, 39, 241/284, 18, 19, 79.1

[56] References Cited

U.S. PATENT DOCUMENTS

| | | | |
|---|---|---|---|
| 2,605,971 | 8/1952 | Andrews | 241/39 |
| 2,655,263 | 10/1953 | Chisholm | 241/39 X |
| 2,672,296 | 3/1954 | Venable | 241/39 |
| 3,491,953 | 1/1970 | Stephanoff | 241/39 |
| 3,508,714 | 4/1970 | Stephanoff | 241/39 |
| 3,741,485 | 6/1973 | Gage et al. | 241/39 |

*Primary Examiner*—Mark Rosenbaum

*Attorney, Agent, or Firm*—Dann, Dorfman, Herrell and Skillman

[57] ABSTRACT

A fluid energy grinding mill having a hollow vessel providing a central cylindrical core zone and a peripheral annular zone both disposed beyond a grinding zone at one end of the vessel. Carrier medium is injected into the grinding zone to generate a vertically-flowing vortex in the core zone. At the other end of the vessel, a first portion of the flow from the vortex is recirculated in a counter flow through an annular peripheral zone surrounding the core zone to interface with injected carrier medium in a grinding zone. A second portion is discharged through a central opening in the other end of the vessel. Particulate material is fed into the recirculating flow so that it may be comminuted in the grinding zone. In the vortex, the particulate material is classified by centrifugal action and the coarse particles are recirculated. The particles ground to the desired mass are discharged with the second portion of the carrier medium which is not recirculated. Several forms of regulation are disclosed for regulating the upwardly-flowing vortex and the portion of the flow which is recirculated. Guide means and deflectors are disclosed to assist in directing the particulate material to follow the desired path.

26 Claims, 5 Drawing Figures

COMMINUTION OF PULVERULENT MATERIAL BY FLUID ENERGY

FIELD OF THE INVENTION

The present invention relates to the comminution of pulverulent matererial by fluid energy, and is directed particularly to an apparatus and method wherein the particulate or pulverulent material is directed into a recirculating flow of fluid carrier medium in a manner to reduce the particle size of the particulate material.

BACKGROUND OF THE INVENTION

Pulverulent material has been subjected to reduction of particle size in fluid energy mills for many years, but the expense of such treatment has rendered it impractical for all except certain limited applications.

Fluid energy mills rely on the introduction of particulate material into a vessel having a high-velocity, normally sonic or supersonic velocity, fluid medium recirculating therein. The circulating flow of fluid medium is normally used to effect a centrifugal separation of the particulate material to permit a withdrawal of the finely-ground material while the coarse material continues its recirculation. The coarse material is reduced in size either by impingement against other particles in the recirculating flow or else by impingement against the vessel walls. In the former case, there is considerable loss of energy in the prior art ways of causing the inter-particle impingement, and in the latter case, there is substantial erosion of the vessel walls due to the high speed impact of the particles against the walls.

Prior to the present invention, the fluid energy mills incorporated one or more of three basic designs, namely the "pancake", the opposed nozzle, and the tubular.

The "pancake" design consists of a short flat cylindrical vessel having tangential inlet nozzles for the fluid carrier medium and a central exhaust outlet. The inlet nozzles are designed to introduce jets of fluid medium into the chamber with an overlap between adjacent nozzles to impart a turbulent condition to the flow which assists the inter-particle impact within the flow. Commercially available mills of this character are normally designed for laboratory use and the flow from the jets carries the particulate material into abrading impact with the walls of the vessel, not only causing rapid deterioration of the vessel walls, but also tending to cause the particles to rebound in towards the center of the vessel where the coarse particles may be entrained in the flow of finely ground particles being carried from the mill through the exhaust port.

In the opposed nozzle mills, the particulate material is introduced into the mill with a jet oriented in one direction and the jet is impacted with a jet from an opposite direction to obtain maximum particle-to-particle impact at the junction of the jets. Although this type of mill avoids a substantial degradation of the vessel wall by the impact of particulate material, there is substantial energy loss through the use of the opposed jets. To assure maximum comminution of the particulate material in such apparatus, it frequently is combined with a "pancake" or a tubular mill.

In the tubular mill, the vessel is in the form of an upright annulus of a particular configuration and the circulation through the annulus is effected by jets disposed tangentially in the bottom portion of the annulus. A substantial part of the grinding effect is obtained in the zone where there is injection of additional jets into the recirculating flow of material, but heavy reliance upon the confinement of the flow by the vessel walls subjects the annular walls of the vessel to a substantial abrading action by the particle-laden fluid medium. As with the pancake mills, the random impact of the heavier particles against the walls of the vessel permits rebounding of these particles into the central outlet of the vessel with the result that the fine particulate material being discharged with the carrier medium is contaminated by the coarser particles which rebound into the discharged flow.

SUMMARY OF THE INVENTION

In accordance with the present invention the pulverulent material is caused to be ground by impingement against other material within the fluid flow so as to avoid the energy loss which is inherent in prior art devices. In this fashion, a highly efficient and effective grinding action is obtained.

The present invention provides a method and apparatus for comminuting pulverulent material in which a highly efficient and effective grinding action is accomplished without substantial impingement of the particulate material against the walls of the vessel in which the random entrainment of oversized particles into the discharge flow is minimized while enabling a high capacity for the treatment of the pulverulent material, the capacity of the mill being sufficient to provide finely ground particulate pulverulent material in quantity suitable for commercial use.

More specifically, the present invention obtains an improved grinding action by the use of a carrier flow which is directed into a vortex within a cylindrical vessel, such as a hollow container, the vortex being controlled to operate within the central zone of the cylindrical vessel in a vertical fashion and wherein surrounding the central vortex a return flow is established which permits repeated recirculation of the fluid carrier medium within the vessel.

Means is provided to generate the vertically-flowing vortex in a manner to provide differential flow velocities within the vortex and the recirculating flow. As the particulate material is displaced from the lower velocity flow area to the higher velocity flow area, it is subjected to acceleration forces, and vice versa, when it is displaced from the higher velocity flow area to the lower velocity flow area it is subjected to deceleration forces. Where the particles are of different mass, the acceleration and decelaration forces affect the particles differently so as to cause varying acceleration and deceleration of the different particles. This variation in acceleration effects an impacting of the particles one upon the other so as to provide an effective grinding action upon the particulate material, without impingement against the vessel walls, and without the energy loss inherent in mills which employ the impact of oppositely-directed jets.

DESCRIPTION OF THE DRAWINGS

All of the objects of the invention are more fully set forth hereinafter with reference to the accompanying drawing, wherein.

DETAILED DESCRIPTION

Figure 1:
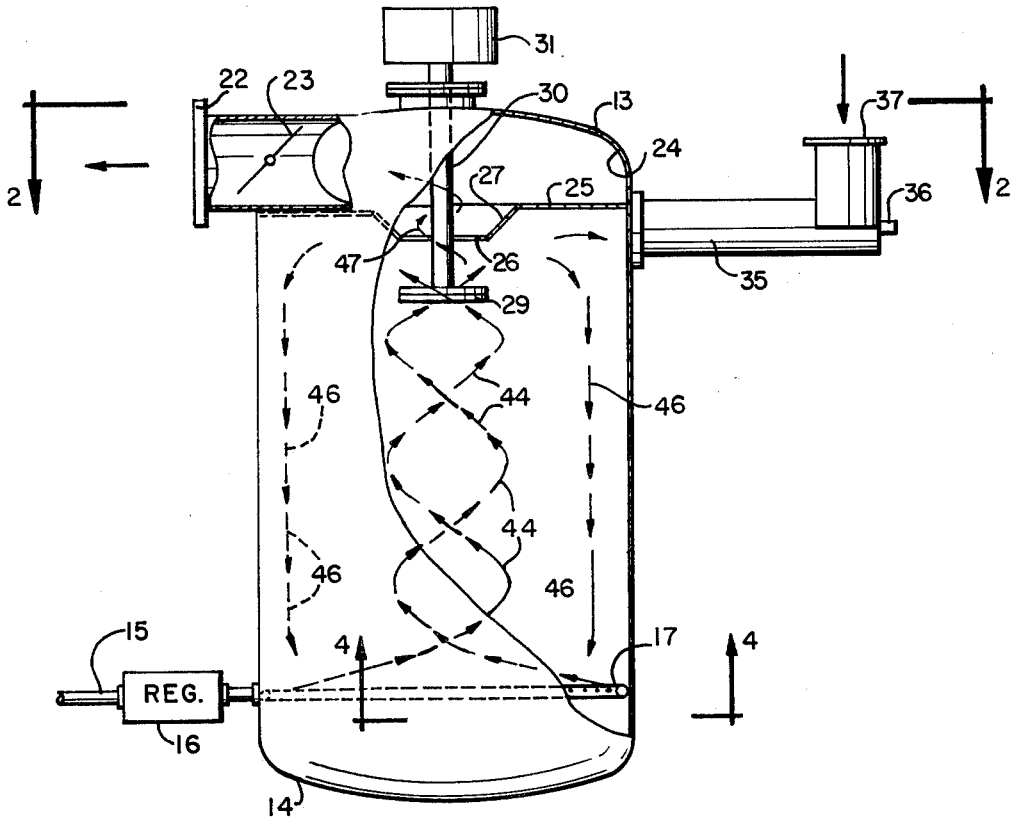
FIG. 1 is a view in side elevation with a portion broken away of the fluid energy mill embodying the present invention.
Figure 2:
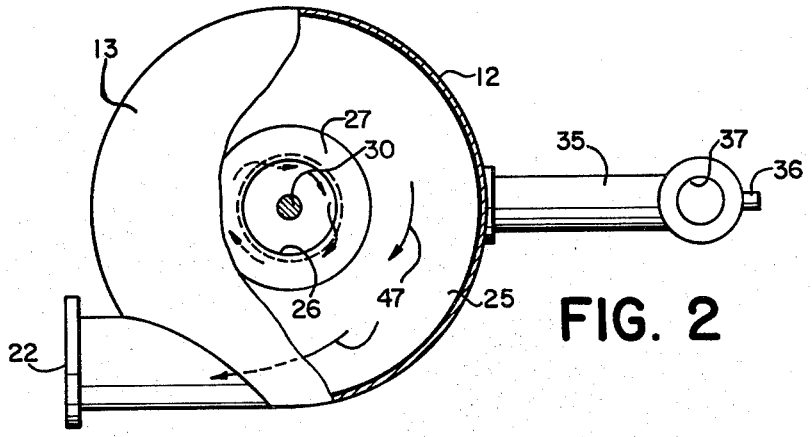
FIG. 2 is a transverse sectional view taken on the line 2—2 of FIG. 1.

Before discussing the structure and operation of the fluid energy mills shown in the drawings, it is useful to examine some of the principles involved in the particle size reduction, the consequences of flow development, and the principles of centrifugal classification utilized in the present invention.

The discharge of a high velocity free jet as a primary flow into a low velocity gas secondary flow results in the establishment of a high shear field between the two flows in which violent turbulence is established due to the development of intense eddy currents. This shear field produces a rapid mixing of the two flows until all of the high velocity gas becomes mixed with the surrounding low velocity gas. Thereafter a mixed flow of intermediate velocity continues to penetrate the low velocity secondary flow with further mixing but at a much lower rate.

During the initial rapid mixing and the slower subsequent mixing phases, any particulate matter in the low velocity secondary flow will be swept into the shear field wherein it is subjected to turbulent and rapid acceleration. Small particles of low mass will achieve very high velocities quickly while larger high mass particles will achieve increased velocities over longer distances or time spans. Thus, in the initial phase, there is established a mixed flow wherein small particles are moving at velocities substantially greater than those of the larger particles. As the mixed flow continues to expand its field and the primary gas flow decelerates, the small particles in the primary flow will tend to decelerate rapidly due to their low mass and high viscous drag, but the larger particles of greater mass will tend to retain their high velocities so that during the subsequent decay portion of the mixed flow the large particles will be moving at velocities substantially greater than those of the small particles. Because of the differing acceleration and deceleration of the particles of different mass, there is substantial frequency of impacts between them.

Size reduction may be achieved by momentum interchange between large and small particles with the small particles overtaking and impacting the large ones in the initial phase of rapid mixing, and the large particles overtaking and impacting on the small ones during the subsequent decay phase. Thus, the particle-to-particle impact is achieved by introducing primary jets of fluid carrier medium into the secondary recirculating flow of the fluid carrier medium in such a fashion as to achieve the desired fluctuations in fluid velocities within the mixed flow. This is accomplished by introducing the primary jets into the secondary flows in substantially the same flow direction so as to minimize energy loss which is experienced in the opposed nozzle type of energy mill discussed above.

In accordance with the present invention, the design of the fluid energy mill is such as to provide a central vertical flow of the fluid medium within the vessel, the central upward flow being in the form of a vortex within a core cylindrical zone in the vessel. A counter or return flow in the annular zone surrounding the core zone is achieved so as to complete the cycle. The energy for achieving the vertical flow in the central vortex is derived by a plurality of injector nozzles disposed circumferentially of the vessel at one end, these nozzles injecting a primary flow of carrier medium into the core zone of the vessel for generating the vertical vortex. A portion of the fluid medium injected at the one end of the vessel is withdrawn at the opposite end to assure flow lengthwise of the vessel. The jets generating the vortex comprise a high velocity flow which is mixed with the secondary recirculating flow which returns to the bottom of the vessel through the annular peripheral zone surrounding the central core.

The energy mill shown in FIG. 1 accomplishes efficient and effective size reduction of particulate material with minimum impingement of the particles against the walls of the vessel. To this end, the structure in FIG. 1 includes a generally upright cylindrical vessel 12. The vessel 12 is a pressure vessel having a domed top wall 13 and bottom wall 14. Means is provided to inject a primary flow of carrier medium into the vessel at the bottom end and to this end, an inlet pipe 15 having regulating means 16 connects through the wall of the vessel 12 to an internal manifold 17 encircling the interior of the vessel 12 adjacent the bottom wall 14. The regulating means 16 controls the condition of the fluid carrier medium to enable control of the intensity of the vortex generated in the vessel. The regulator may control one or more of the pressure, temperature, mass flow, density, and composition of the fluid carrier medium introduced into the manifold 17.

The fluid medium is exhausted at the top end of the vessel through a discharge outlet 22. In the present instance the discharge outlet 22 has a flow regulating damper 23 and constitutes a tangential outlet to a discharge chamber 24 as a part of the top wall means by a transverse partition 25 having a central outlet 26 therein. In the present instance, the outlet 26 is defined by a downwardly-flared wall portion 27 projecting centrally within the cylindrical vessel 12. A disk-like deflector element 29 is positioned below the outlet opening 26 and a regulating shaft 30 supports the deflector element 29 at a selected position below the outlet to thereby regulate the flow area between the element 29 and the opening 26. Adjusting means is provided at 31 to alter the vertical position of the deflector element 29 and thereby regulate the effective flow area through the opening 26. By regulating either or both of the damper 23 and the element 29, the pressure within the vessel 12 may be adjusted to control the amount of particulate material which is recirculated with the fluid medium in the vessel. Restricting the exhaust of the fluid medium increases the pressure within the vessel and causes a recirculation of a larger portion of the particulate material within the vessel as described more fully hereinafter. When treating certain materials, the deflector element 29 may be eliminated and the control of the exhaust may be accomplished by regulation of the damper 27 or may be accomplished by a fixed discharge flow area which is calculated in the design of the equipment.

The work material, normally pulverulent material having a range of particle sizes is introduced into the vessel 12 below the partition 25 of the top wall means by a feeder 35, in the present instance a feed auger having a drive shaft 36 which transmits the material from a feed hopper 37 through the feeder 35 into the pressure vessel 12.

In accordance with the invention, the flow of fluid carrier medium from the manifold 17 is controlled to effect a vertical flow in one direction within a central core zone of the vessel 12 with a secondary recirculating flow in the opposite direction in the annular zone surrounding the central core zone. In the present instance, the vortex flow is upward in the core zone and downward in the peripheral zone. The upward flow is assured by the position of the outlet in the upper end of the vessel, and the intensity of the flow is enhanced by upwardly-directed jets of the carrier medium. To this end, the manifold 17 is provided with nozzle means 41 spaced circumferentially about the lower level of the vessel 12 to inject high-velocity jets of carrier medium into the vessel at an upwardly inclined angle relative to the horizontal plane, as indicated diagrammatically by the flow arrows 42 in FIG. 3, and at an angle offset from the radial direction R as indicated by the arrows 43 in FIG. 4. As a result of this dual inclination of the nozzles 41, the multiple jets of fluid medium issuing from the manifold 17 combine to generate an upwardly-flowing vortex having a vertical axis, the flow being as indicated by the arrows 44 in FIG. 1. The shallow angular position indicated by the arrows 43 in FIG. 4 confines the upwardly-flowing vortex 44 to the central core zone of the chamber 12. The clockwise circular flow in the vortex 44 continues toward the top wall and in the present instance, the upward travel is arrested at the partition 25 of the top wall means.

Figure 3:
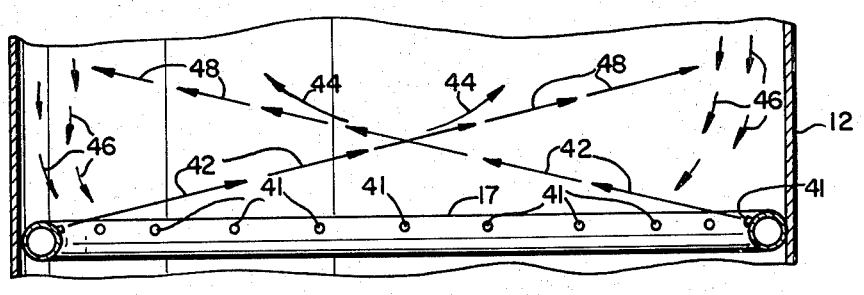
FIG. 3 is an enlarged fragmentary cross section of the lower part of the mill shown in FIG. 1.

Upon reaching the partition, a first portion of the circulation flow is deflected by the partition outwardly into the annular peripheral zone surrounding the central core zone, causing a downward secondary flow as indicated by the arrows 46 in FIGS. 1 and 3, and a second portion is discharged through the outlet opening 26, as indicated by the arrows 47. The clockwise circular flow generated by the vortex 44 is not terminated by the flow separation occasioned by the partition 25 but for the purpose of illustration, the arrows 46 indicate a straight downward flow in FIG. 1. As shown in FIG. 1, the downward flow in the peripheral zone as indicated by the arrows 46 passes the feed device 35 and entrains the particulate matter which is fed into the vessel through the feeder 35. Thus, the secondary flow in the annular peripheral zone is laden with the particulate matter fed into the vessel. The downward secondary flow with the particulate matter entrained therein surrounds the nozzles 41 and is introduced into the primary flow issuing from the nozzles 41 and is aspirated into the flow by the high velocity jet action of the nozzles. In this manner, the high velocity jets are effective to interface with the lower velocity secondary flow having the particulate matter entrained therein, and to provide an interchange of momentum therebetween.

Figure 4:
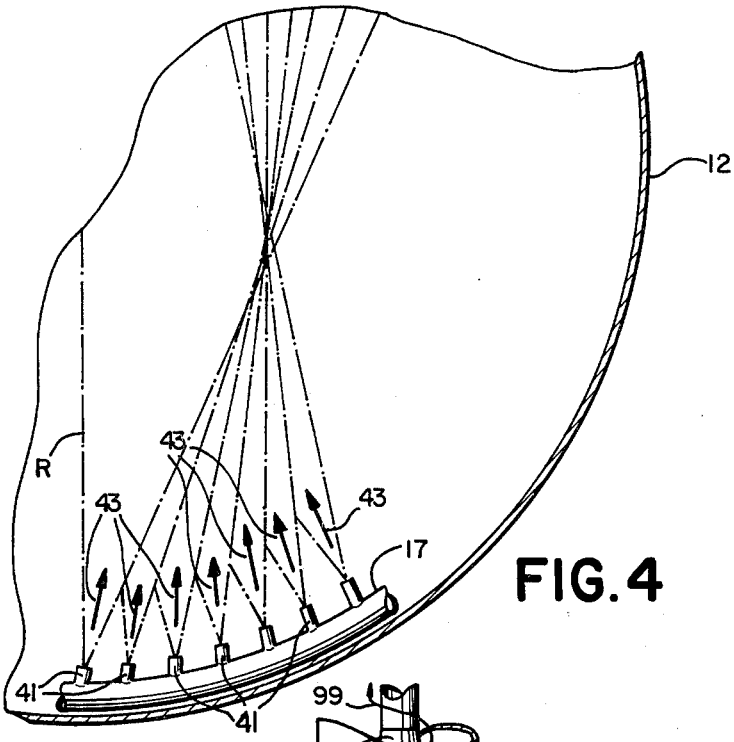
FIG. 4 is an inverted fragmentary sectional view taken on the line 4—4 of FIG. 1.

As discussed above, the interchange effected by the mixture of the primary and secondary flows generates shear fields surrounding the high velocity core of the jets in which the particulate matter is comminuted and reduced in mass. This reduction is effected primarily in the grinding zone at the bottom of the vessel 12. The particles of smaller mass follow the upward spiral in the vortex 44 whereas, as shown in FIG. 4, the particles of larger mass may tend to follow the straight path of the high velocity flow as indicated by the arrows 48. These larger particles thereby are subjected to the subsequent secondary mixing discussed above and impact against the slower moving particulate material. As shown in FIG. 4, these particles also intercept the secondary flow as indicated by the arrows 46 prior to impinging against the walls of the vessel 12 and the secondary flow at the remote end of the jets thereby deflects the particles from perpendicular impingement against the vessel walls. These large particles are thereby entrained in the secondary flow and are again injected into the primary flow issuing from the nozzles.

Preferably, the supply 15 and regulator 16 inject the fluid medium through the nozzles at an intensity which generates a sonic flow within the jets. The efficiency of the mill is optimized when the flow in the issuing portion of the jet is at sonic velocity, but the mill is effective in both the subsonic and the supersonic range. The nozzles are adjustable either individually or in unison to determine the angularity relative both to the radius R and to the horizontal plane of the manifold 17, so that the intensity of the vortex generated by the combined jets issuing from the nozzles may be regulated to the desired degree. The intensity of the vortex and its height determine the size of those particles which are retained within the interior of the core zone and are discharged with that portion of the flow of the vortex which is exhausted through the central opening 26. The particles below a given mass will remain within the inner part of the upwardly-flowing vortex, whereas the larger particles will be centrifugally classified and deflected into the outer secondary flow in the peripheral zone. By increasing the angle of the nozzles relative to the radius R, the intensity of the vortex may be increased to reduce the particle size which is discharged through the central opening 26. Conversely, reducing the angle of the jets relative to the radius R will reduce the vortex intensity and increase the particle size which is discharged through the central opening. In FIG. 1, the height of the core zone is approximately 1.5 times the diameter of vessel 12, and the intensity of the vortex is such that the upward flow of the vortex embraces at least 90° circumferentially between the nozzles 41 and the partition 25 of the top wall means.

In the present instance, the nozzles 41 generate a spray divergence angle of about 25° with the velocity decreasing in the spray at increasing distances from the issuing flow of the jets. As shown in FIG. 3, the inclination of the jets is about 12.5° so that the lower limit of the spray angle is substantially horizontal, thereby conserving maximum flow energy in generating the upwardly-flowing vortex. In FIG. 4, the angularity of the jets, as indicated by the arrow 43 relative to the radius, is also on the order of 12.5° so that the spray issuing from the nozzle does not intersect the radius R.

Thus, it is possible to state general conditions for the preferred arrangement of a fluid energy grinding system. First, the area of the shear field should be maximized, and this is done by maximizing the number of nozzles and minimizing the mass flow through each one. Second, the unimpeded length of the free jet is maximized in order that the shear field area is as great as possible and so that the maximum amount of momentum is transferred from the primary jet flow to the particles in the recirculating flow before any interaction between the mixed flows reduces the velocity of the primary flow. Third, the mass of the particles in the recirculating flow must be great enough to absorb the momentum of the free jets with the result that the velocity of the mixed flow is minimized within a reasonable size of vessel. Fourth, sufficient distance must be provided for reducing the momentum of large particles either by deceleration or by additional size reduction, and this feature also contributes to reducing high velocity impingements which cause destructive wear of the vessel. Fifth, enough space must be provided between the nozzles to permit the recirculating flow to completely envelop the free jets issuing from the nozzles.

An array of nozzles can be provided using various geometric arrangements, but there remains the necessity of removing product and spent carrier fluid from the processor, and vortex flow of the two-phase system is very effective in centrifuging large particles from the inner portion thereof, the primary parameters being the strength of the vortex, the time available for the larger particles to be displaced outwardly to a sufficient distance to prevent their capture in the exhaust from a centrally located outlet, and the freedom of the large particles to traverse the vortex cord-wise without encountering any obstruction. Lastly, the recirculation of the medium must be controlled for the optimization of the grinding operation. The above requirements have been accommodated by the instant invention and the operating parameters have been optimized in the preferred embodiment.

A practical example will now be given to demonstrate the design of a processor which embodies the foregoing preferred features.

A nozzle discharging 500 pounds of superheated steam per hour into a two-phase mixture of coal dust and steam dissipates within 58 inches and produces no detectable wear on a mild steel plate after several hundred hours of operation. The same jet caused destructive wear when the plate is moved to within 18 inches of the nozzle. Based on this data, a hollow cylindrical vessel of 60 inches diameter is suitable for the flows created in accord with the present invention using a plurality of nozzles each of which delivers 500 pounds per hour of superheated steam.

A device which uses 60 nozzles with a throat diameter of 17/64 inch disposed around the base of the vessel at an angle of 12½ degrees from the radial direction provides sonic flow velocities at a rate of 30,000 pounds per hour of superheated steam when the manifold steam conditions are 200 psig and 700° F. A sonic velocity is in the range of 1950 ft./sec. in this steam atmosphere. The vortex generated by this primary flow is of an intensity which retains particles above 20 microns mass within the vessel, whereas particles which have been comminuted to a mass of 20 microns or less are discharged through the outlet with the spent steam.

Figure 5:
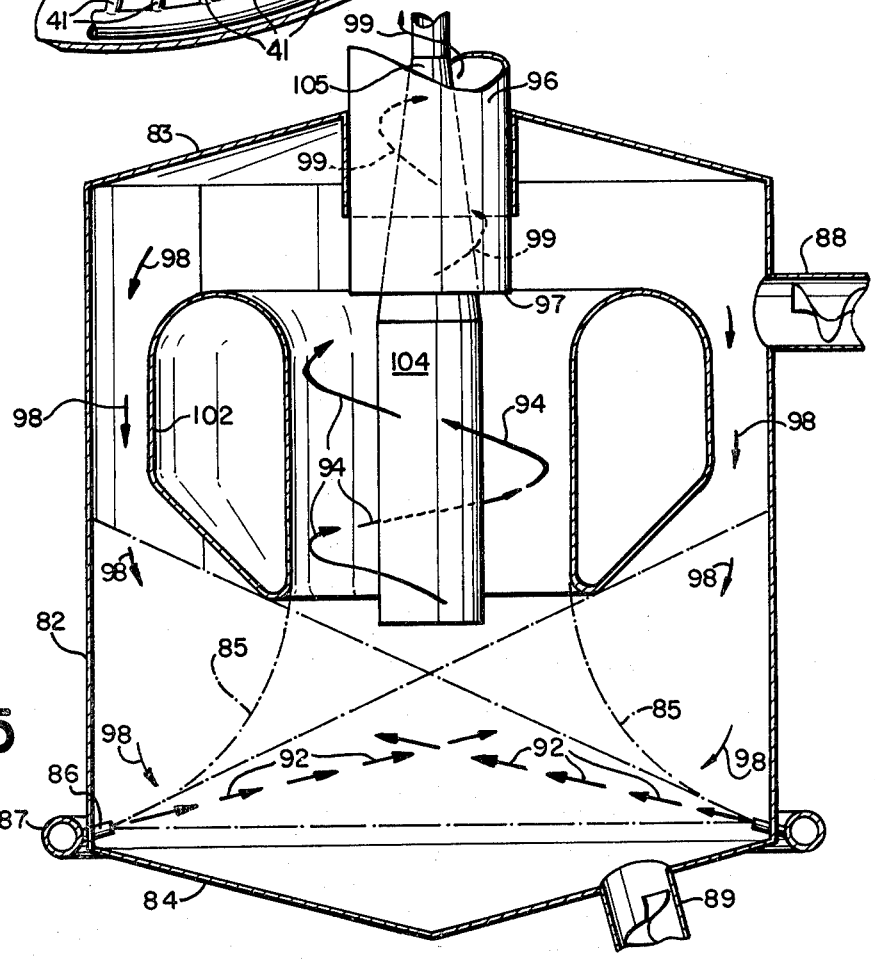
FIG. 5 is a transverse sectional view through a modified embodiment of a fluid energy mill embodying the present invention and incorporating additional feed and control means which may be used to facilitate the practice of the present invention.

FIG. 5 illustrates a mill in accordance with the present invention wherein the configuration of the mill incorporates modifications.

In the mill of FIG. 5, the vessel has a hollow cylindrical shell 82 with frustoconical top and bottom walls 83 and 84 respectively. The fluid carrier medium is introduced as a primary flow from a manifold 87 which is disposed at the lower end of the cylindrical shell 82 in circumscribing relation thereto. The manifold 87 is connected to a supply of pressure fluid in a conventional manner and has a plurality of nozzles 86 projecting through the shell into the interior thereof. The nozzles 86, in the present instance, are inclined to the vertical and to the radial direction by an angle of 12½ degrees similarly to the respective inclinations of the nozzles 41 so that the primary flow of pressure fluid medium intensifies the upwardly-flowing vortex within the central core zone of the shell 82. In FIG. 5, the envelope of the vortex is indicated in dot-and-dash lines identified at 85.

The mill has two feeders 88 and 89 for introducing pulverulent material into the vessel. The feeder 88 is positioned in the cylindrical shell 82, whereas the feeder 89 is positioned in the bottom wall 84. Where the feeder 88 feeds into the secondary flow above the grinding zone, the feeder 89 feeds directly into the grinding zone where it may be drawn vertically into the vortex generated by the nozzles 86. Either or both feeders may be operated to supply fresh pulverulent material to the grinding mill.

As in the embodiment of FIGS. 1–4, the jets from the nozzles 86 project a high velocity issuing flow indicated at 92 cord-wise across the cylindrical shell with an unobstructed flow path throughout. The combined effect of the several primary flows issuing from the nozzles 86 generates the vertical flow in the form of a vortex, as indicated by the arrows 94 in FIG. 5. Centrally within the upper top wall 83, an outlet passageway is provided, as indicated at 97. The passageway is provided by a tubular duct 96 which is vertically adjustable in the top wall 83 to position its lower open end at varying levels within the central core zone of the vessel 82. The particles of the material entrained in the upwardly-flowing vortex which are below the critical mass flow outwardly through the tube 96 with that portion of the carrier medium which is discharged therethrough as indicated by the arrows 99. The remainder of the carrier medium is recirculated radially outward and downwardly as indicated by the arrows 98 and is caused to merge with the primary medium flow issuing from the nozzles 86 at the lower end of the cylindrical shell 82. In the present instance, a guiding annulus 102 is positioned coaxially within the shell 82 having an inner diameter coincident with the envelope 85 of the vortex and having an outer diameter spaced inwardly from the shell 82 to provide an annular passageway for the secondary flow 98. It is noted that the feeder 88 opens into the vessel opposite the annulus 102, so that the fresh material introduced through the feeder 88 is isolated from the vortex 94 as it enters the secondary flow 98. It should also be noted that the lower end of the annulus 102 terminates above the grinding zone and is sufficiently above the nozzles 86 to avoid obstructing the flow paths from the nozzles 86.

In order to minimize eddy current flows within the central eye of the vortex 85, a plug element 104 depends downwardly through the opening 97 into the eye of the vortex. The plug 104 is effective to eliminate eddy current flows in the eye of the vortex and thereby is effective to enhance the centrifugal classification of the particles in the upwardly-flowing vortex. As shown in FIG. 5, the plug element extends downwardly through the vortex to a level above the grinding zone. In the present instance, the plug element 104 also cooperates with the adjustable tubular element 96 to regulate the flow area of the discharge outlet 97 and thereby regulate the pressure within the shell 82. When the tubular element 96 is elevated, the bottom thereof registers with a smaller diameter of the tapered portion 105 of the plug element 104 to thereby provide a larger flow area for the discharge 99 of carrier medium and the particles carried thereby. Conversely, when the tubular element 96 is adjusted downwardly, its lower end registers with a larger diameter of the tapered portion 105 thereby reducing the flow area between the plug and the tube and increasing the pressure within the vessel.

In operation, the embodiment of FIG. 5 may function similarly to that of FIGS. 1–4 in that the particulate material is introduced through the feed device 88 into the recirculating secondary flow identified by the arrows 98 and this fresh particulate material flows downwardly for entrainment into the primary flow injected by the jets issuing from the nozzles 86. As in the embodiment of FIG. 1, the downwardly-flowing particulate material impinges with any residual particles which are projected cord-wise across the vessel without being entrained in the upwardly-flowing vortex to thereby impact with these particles and effect an interchange of flows to carry the particles downwardly into the jets at the bottom of the vessel. In addition, or alternatively, particulate material may be introduced directly into the grinding zone through the feeder 89.

While particular embodiments of the present invention have been herein illustrated and described, it is not intended to limit the invention to such disclosure but changes and modifications may be made therein and thereto within the scope of the following claims.

I claim:

1. A fluid energy mill for grinding pulverulent material comprising a vessel having a closed bottom providing a grinding zone at one end, outlet means at the other end, and a generally cylindrical core zone having an axis disposed generally centrally within said vessel between said grinding zone and said outlet means, and an annular peripheral zone surrounding said generally cylindrical core zone, a plurality of circumferentially-spaced ejector nozzles for injecting fluid carrier medium into said grinding zone in a direction between a radius to said central zone axis and a direction perpendicular to said radius, all of said nozzles being disposed in said grinding zone to inject a primary flow of fluid carrier medium into said vessel through said grinding zone, said nozzles cooperating with said closed bottom and said outlet means so as to generate an axially-flowing vortex within said central zone, said vessel having transverse wall means at the other end spaced from said grinding zone to intercept the axially-flowing vortex and deflect at least a first portion of the medium therein outwardly into the peripheral zone, the fluid medium being deflected into said peripheral zone flowing oppositely as a secondary flow and being introduced into said primary flow issuing from said nozzles to thereby effect a recirculation of the fluid carrier medium within said vessel, and feed means to introduce pulverulent material into said circulating flow of fluid carrier medium, so that the material is introduced into said primary flow for fluid energy grinding thereof, said outlet means at the remote end of said vortex operable to withdraw a second portion of said fluid medium and with it a fraction of the pulverulent material which has been reduced in mass below a predetermined limit in said grinding zone.

2. Apparatus according to claim 1 including means to regulate the conditions of the fluid carrier medium supplied to said nozzles to thereby control the intensity of the medium flow in the vortex, and thereby the fractional classification of the pulverulent material discharged through said outlet means with said second portion of the fluid medium.

3. Apparatus according to claim 2 wherein the intensity of the vortex in said core zone is sufficient to afford flow in said vortex circumferentially through at least 90° between any nozzle and the outlet means.

4. Apparatus according to claim 1 wherein said nozzles have a divergent spray angle providing a high velocity issuing flow and a decreasing flow velocity at increasing distances from said issuing flow, said plurality of nozzles being spaced apart a distance sufficient to provide varying flow velocities at positions intermediate the high-velocity issuing flows of adjacent nozzles.

5. Apparatus according to claim 4 wherein said vessel comprises a hollow cylindrical shell, said grinding zone affording an unobstructed flow path for the issuing flow from each nozzle extending from the nozzle to the wall portion of said shell opposite to said nozzle.

6. Apparatus according to claim 5 wherein said unobstructed flow path terminates at said opposite wall portion and is intercepted by said secondary flow from said peripheral zone adjacent said opposite wall portion.

7. Apparatus according to claim 5 including annular guide means mounted within said vessel spaced inwardly from said shell to separate said core zone from said peripheral zone, said guide means extending from said grinding zone at one end to a level spaced from said transverse wall means at its other end whereby said fluid carrier medium has primary flow axially toward said other end within said annular guide means and counter flow axially toward said one end outside of said annular guide means.

8. Apparatus according to claim 7 wherein said feed means includes an opening in said cylindrical shell at a level between the ends of said guide means, thereby introducing pulverulent material into the counter flow of said carrier medium.

9. Apparatus according to claim 5 wherein said feed means includes an opening into said grinding zone, thereby introducing pulverulent material directly into said grinding zone.

10. Apparatus according to claim 5 including elongated plug means disposed axially in said core zone, terminating at said one end beyond said grinding zone to prevent formation of eddy currents along the central axis of said vortex.

11. Apparatus according to claim 10 wherein said outlet means comprises a central circular opening in said transverse wall, said plug means extending through said opening to define with said opening an annular discharge passageway for said second portion of the fluid medium and the fraction of pulverulent material entrained therein.

12. Apparatus according to claim 11 including means to regulate the flow area of said annular discharge passageway.

13. Apparatus according to claim 12 wherein said outlet means comprises an axially extendable and retractible tubular duct projecting axially into said core zone from said transverse wall means in circumscribing relation to said plug means, the outer diameter of said plug means being tapered within the open lower end of said duct so that extension of said duct reduces the flow area and retraction of said duct increases the flow area.

14. Apparatus according to claim 4 wherein the axis of said core zone is vertical and the nozzles are inclined to the horizontal plane with an angle of inclination of at least ½ the divergent spray angle of said nozzles.

15. Apparatus according to claim 4 wherein said nozzle direction is offset from the direction of a radius of said central core axis by an angular distance at least ½ the divergent spray angle.

16. Apparatus according to claim 4 wherein said divergent spray angle is approximately 25°.

17. Apparatus according to claim 4 including means to supply carrier medium to said nozzles to generate an issuing flow velocity in the sonic range.

18. Apparatus according to claim 1 wherein said outlet means includes adjustable flow-regulating means to control the pressure within said vessel.

19. Apparatus according to claim 18 wherein said outlet means includes an exhaust chamber beyond said transverse wall means coaxial with said core zone and communicating therewith through an axial passage therebetween, said flow regulating means comprising a disk coextensive with said passage and disposed in said core zone, the spacing between said disk and said passage providing a flow area less than the flow area through said axial outlet passage.

20. Apparatus according to claim 19 including a support shaft for said disk mounted for axial adjustment in said exhaust chamber and projecting through said passage to support said disk at a selected spacing from said passage.

21. Apparatus according to claim 18 wherein said outlet means includes an exhaust chamber beyond said transverse wall means coaxial with said core zone and communicating therewith through an axial passage therebetween, said exhaust chamber having a tangential exhaust passage with a damper therein to regulate pressure in the mill.

22. A method of comminuting a pulverulent material having particles with varying means comprising the steps of supplying a primary flow of fluid medium to a vessel, generating an axially-flowing vortex of said fluid medium in a core zone within said vessel, deflecting a first portion of the axially-flowing medium outwardly at the remote end of said core zone into a peripheral zone surrounding said core zone, directing said first portion in a counter flow through in said peripheral zone and introducing it into said primary flow to effect recirculation of said fluid medium, discharging a second portion of said flow through an outlet at the remote end of said core zone and introducing pulverulent material into said recirculating flow, said comminuting being effected by supplying said fluid medium in a plurality of jets projected inwardly of said vessel from adjacent its circumference, said jets having divergent spray angles providing a high-velocity issuing flow and decreasing flow velocities at increasing distances from said issuing flow, said jets being spaced apart a distance to provide varying flow velocities intermediate the issuing flows of said jets, the pulverulent material being entrained in said jets and thereby being subjected to varying accelerations dependent upon the flow velocity of the medium entraining the material and the mass of the particles entrained, the varying acceleration effecting impacts between said particles.

23. A method according to claim 22 wherein said step of supplying fluid medium is controlled to provide an issuing flow velocity in said jets in the sonic range.

24. A method according to claim 22 wherein the axially-flowing vortex effects a centrifugal classification of the particles of the pulverulent material entrained in said vortex, the particles greater than a given mass being recirculated with the secondary flow, and including the step of discharging the remaining particles with said second portion through a central discharge passage disposed axially beyond said vortex.

25. A method according to claim 22 including the step of providing an elongated unobstructed free path for the issuing flow from each nozzle, introducing said secondary flow into said path adjacent the nozzle and intercepting said path with said secondary flow at the remote end of said path.

26. A method according to claim 22 wherein said jets are controlled to provide a circumferential displacement of at least 90° between said jets and said outlet of said vortex.

* * * * *

UNITED STATES PATENT AND TRADEMARK OFFICE

CERTIFICATE OF CORRECTION

PATENT NO. 4,219,164

DATED August 26, 1980

INVENTOR(S) : DAVID W. TAYLOR

It is certified that error appears in the above-identified patent and that said Letters Patent are hereby corrected as shown below:

Column 5, line 33, change the spelling of "circulation" to --circulating--.

Column 6, after line 52, inert --The spray angle of 25° shown in Figs. 4 and 5 not only insures a decreasing flow velocity at increasing distances from the issuing flow, but also provides a flow velocity gradient between the center of the flow and the ambient atmosphere beyond the spray angle. The divergent spray angle of 25° provides a generally conical flow envelope within which the spray is concentrated. Outside the envelope adjacent the nozzle, the atmosphere is ambient so that the particles within the spray are subjected to frictional resistance at the envelope and are at a reduced velocity, and there is therefore a velocity gradient between the center of the spray and the envelope. As shown in Fig. 4 it is apparent that the spacing of the nozzles about the circumference of the vessel insures that there are points of maximum flow velocity as indicated by the heavy arrows 43. Between the arrows 43 the

UNITED STATES PATENT AND TRADEMARK OFFICE

CERTIFICATE OF CORRECTION

PATENT NO. : 4,219,164

DATED : August 26, 1980

INVENTOR(S) : DAVID W. TAYLOR

It is certified that error appears in the above-identified patent and that said Letters Patent are hereby corrected as shown below:

flow velocity decreases to provide varying flow velocities intermediate these high-velocity issuing flows.--

Signed and Sealed this

*Twenty-third* Day of *December 1980*

[SEAL]

*Attest:*

SIDNEY A. DIAMOND

*Attesting Officer*

*Commissioner of Patents and Trademarks*